US008398190B2

(12) United States Patent
Kumagai

(10) Patent No.: US 8,398,190 B2
(45) Date of Patent: Mar. 19, 2013

(54) FLUID EJECTION DEVICE AND FLUID STIRRING METHOD FOR THE SAME, AND FLUID STORAGE DEVICE AND FLUID STIRRING METHOD FOR THE SAME

(75) Inventor: Toshio Kumagai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 1 day.

(21) Appl. No.: 13/293,249

(22) Filed: Nov. 10, 2011

(65) Prior Publication Data

US 2012/0127243 A1 May 24, 2012

(30) Foreign Application Priority Data

Nov. 22, 2010 (JP) ..... 2010-259837

(51) Int. Cl.
*B41J 29/38* (2006.01)
*B41J 2/175* (2006.01)

(52) U.S. Cl. ..... 347/6; 347/86

(58) Field of Classification Search ..... 347/6, 85–86; 366/224, 273, 274, 317; 416/3; 435/302.1; 436/526

See application file for complete search history.

(56) References Cited

U.S. PATENT DOCUMENTS

| | | | | |
|---|---|---|---|---|
| 4,876,069 | A * | 10/1989 | Jochimsen | 422/73 |
| 4,916,081 | A * | 4/1990 | Kamada et al. | 436/526 |
| 5,533,800 | A * | 7/1996 | Stiegelmann et al. | 366/142 |
| 6,817,705 | B1 * | 11/2004 | Crockett et al. | 347/85 |
| 6,989,054 | B2 | 1/2006 | Tanabe et al. | |
| 7,293,849 | B2 * | 11/2007 | Tani et al. | 347/6 |

FOREIGN PATENT DOCUMENTS

| | | | |
|---|---|---|---|
| JP | 3039583 | U | 7/1997 |
| JP | 3048835 | U | 5/1998 |
| JP | 2002-348513 | A | 12/2002 |
| JP | 2009-045944 | A | 3/2009 |

* cited by examiner

*Primary Examiner* — Anh T. N. Vo
(74) *Attorney, Agent, or Firm* — Global IP Counselors, LLP

(57) ABSTRACT

A fluid storage device for storing a fluid, and a fluid ejection head for ejecting the fluid fed from the fluid storage device are provided. The fluid storage device is provided with a storage tank, and a spherical body formed of a magnetic material and provided inside the storage tank. Also provided are three or more attraction devices for attracting the spherical body; and a switching device for switching between attraction and non-attraction by the attraction devices according to a movement path selected from a plurality of movement paths based on a predetermined selection condition, and moving the spherical body inside the storage tank in the selected movement path.

15 Claims, 2 Drawing Sheets

FLUID EJECTION DEVICE AND FLUID STIRRING METHOD FOR THE SAME, AND FLUID STORAGE DEVICE AND FLUID STIRRING METHOD FOR THE SAME

CROSS-REFERENCE TO RELATED APPLICATIONS

This application claims priority to Japanese Patent Application No. 2010-259837 filed on Nov. 22, 2010. The entire disclosure of Japanese Patent Application No. 2010-259837 is hereby incorporated herein by reference.

BACKGROUND

1. Technical Field

The present invention relates to a fluid ejection device and a fluid stirring method for the same, and to a fluid storage device and a fluid stirring method for the same.

2. Related Art

Inkjet-type printers as fluid ejection devices have small size and high quality and are rapidly gaining in popularity. Pigment-based ink (fluid) in which minute pigment particles are suspended also has high reflection density and excellent image quality on normal paper, and is therefore widely used. However, when pigment ink is stored statically for a long time, the pigment particles precipitate out of the solvent, and a layer of high pigment concentration occurs at the bottom of the ink tank.

For example, titanium dioxide pigment having high weather resistance is preferred for use as a white inkjet ink, but the titanium dioxide pigment rapidly precipitates and aggregates, due to the high specific gravity thereof with respect to the solvent, thereby creating significant problems with storage stability.

Japanese Registered Utility Model No. 3039583 and Japanese Registered Utility Model No. 3048835 disclose techniques whereby a spherical stirrer is placed inside an ink tank to agitate the ink tank.

Japanese Laid-Open Patent Publication No. 2009-045944 discloses a technique whereby a moving body for stirring is provided inside an ink chamber, the moving body for stirring is retained by magnetism during printing, and during stirring, the moving body for stirring is moved in conjunction with movement of a cartridge which includes the ink chamber.

SUMMARY

However, such problems as the following arise in conventional techniques such as those described above.

Since ink aggregation is difficult to break up by a liquid current created by movement of a stirrer, direct contact of the stirrer with the aggregated ink is preferred, but because the region of stirring by the stirrer cannot be prescribed in the techniques described in Patent Japanese Registered Utility Model No. 3039583 and Japanese Registered Utility Model No. 3048835, printing may be initiated while aggregated ink still remains due to inadequate stirring. The techniques described in these publications also necessitate agitation by a worker, and are difficult to apply to a device in which unmanned operation is required.

In the technique described in Japanese Laid-Open Patent Publication No. 2009-045944, since the region of stirring by the stirrer is uniform, printing may be initiated while aggregated ink still remains in a region outside the region of stirring.

Moreover, the aggregation state of the ink varies according to the standing time of the ink, but it is difficult to apply stirring that is suitably adapted to the aggregation state by the techniques described in the above mentioned publications.

These problems are not limited to pigment-based ink, and can occur in the same manner for liquid suspensions which include metal microparticles used to form metal wiring through use of a fluid ejection device, for example.

The present invention was developed in view of the foregoing, and an object of the present invention is to provide a fluid ejection device and fluid stirring method for the same, and to provide a fluid stirring device and fluid stirring method for the same whereby aggregation can be effectively broken up according to the state of the ink or other fluid.

A fluid ejection device according to one aspect of the present invention includes a fluid storage device, three or more attraction devices, a switching device and a fluid ejection head. The fluid storage device is configured and arranged to retain a fluid. The fluid storage device includes a storage tank, and a spherical body foimed of a magnetic material and provided inside the storage tank. The attraction devices are configured and arranged to selectively attract the spherical body. The switching device is configured and arranged to switch between attraction and non-attraction by each of the attraction devices according to a movement path selected from a plurality of movement paths based on a predetermined selection condition, and to move the spherical body inside the storage tank in the selected movement path. The fluid ejection head is configured and arranged to eject the fluid fed from the fluid storage device Consequently, in the fluid ejection device according to this aspect, by switching separately between attraction and non-attraction by the attraction devices to move the spherical body in a predetermined movement path, aggregation can be effectively broken up by bringing the spherical body into contact with an aggregated part (precipitate) of the liquid. By also selecting the movement path of the spherical body according to the aggregation state in the liquid, the spherical body can be effectively moved through areas of significant aggregation, and other areas.

With the fluid ejection device as described above, the attraction devices are preferably disposed at a distance from the storage tank in a circumferential direction of the storage tank.

Through this configuration, by sequentially switching between attraction and non-attraction of the spherical body by the attraction devices disposed in the circumferential direction, the spherical body can be made to orbit in the circumferential direction. Therefore, in a case in which the storage time of the liquid is relatively short and there is minimal aggregation, for example, aggregation can be effectively broken up by contact with the orbiting spherical body and the liquid current created by the orbiting.

With the fluid ejection device as described above, the attraction devices are preferably provided as a pair of the attraction devices disposed on both sides of a center of the storage tank in a radial direction of the storage tank.

Through this configuration, by sequentially switching the attraction of the spherical body between one and the other of the attraction devices of the pair, the spherical body can be moved in the radial direction through the center of the storage tank. Therefore, in a case in which the storage time of the liquid is relatively long and significant aggregation has occurred at the center part, for example, aggregation can be effectively broken up by moving the spherical body through the center in the radial direction.

With the fluid ejection device as described above, the movement paths preferably include a first movement path of movement in the circumferential direction, and a second movement path including both movement in the circumferential direction and movement in the radial direction of the storage tank.

Through this configuration, the first movement path and the second movement path can be arbitrarily selected according to the aggregation state.

With the fluid ejection device as described above, the predetermined selection condition is preferably set according to a storage time of the fluid in the storage tank.

Through this configuration, the movement path of the spherical body can be selected from a plurality of movement paths with the storage time of the fluid as a threshold value criterion for measuring the aggregation state.

With the fluid ejection device as described above, the predetermined selection condition is preferably set according to a time from a start of attraction of the spherical body.

Through this configuration, the abovementioned second path, for example, may be selected at the start of attraction, when the aggregation state is relatively severe, and the abovementioned first path, for example, may be selected after the start of attraction, when the aggregation state has decreased.

With the fluid ejection device as described above, the switching device is preferably configured and arranged to adjust a movement speed of the spherical body according to the selected movement path.

Through this configuration, since the movement of the spherical body may cause bubbles to form when the spherical body moves in the path through the center of the storage tank, for example, the movement of the spherical body can be prevented from forming bubbles by reducing the movement speed of the spherical body when such a path is taken.

A method according to another aspect is a method for stirring a fluid in a fluid storage device in a fluid ejection device including the fluid storage device having a storage tank for storing a fluid with a spherical body formed of a magnetic material provided inside the storage tank, and a fluid ejection head for ejecting the fluid fed from the fluid storage device. The method comprising: selecting a movement path for the spherical body inside the storage tank from a plurality of movement paths based on a predetermined selection condition; and switching between attraction and non-attraction by each of three or more attraction devices configured and arranged to selectively attract the spherical body according to the selected movement path.

Consequently, by the fluid stirring method for a fluid ejection device according to this aspect, by switching separately between attraction and non-attraction by the attraction devices to move the spherical body in a predetermined movement path, aggregation can be effectively broken up by bringing the spherical body into contact with an aggregated part (precipitate) of the liquid. By also selecting the movement path of the spherical body according to the aggregation state in the liquid, the spherical body can be effectively moved through areas of significant aggregation, and other areas.

With the method as described above, the attraction devices are preferably disposed at a distance from the storage tank in a circumferential direction of the storage tank.

Through this configuration, by sequentially switching between attraction and non-attraction of the spherical body by the attraction devices disposed in the circumferential direction, the spherical body can be made to orbit in the circumferential direction. Therefore, in a case in which the storage time of the liquid is relatively short and there is minimal aggregation, for example, aggregation can be effectively broken up by contact with the orbiting spherical body and the liquid current created by the orbiting.

With the method as described above, the attraction devices are preferably provided as a pair of the attraction devices disposed on both sides of a center of the storage tank in a radial direction of the storage tank.

Through this configuration, by sequentially switching the attraction of the spherical body between one and the other of the attraction devices of the pair, the spherical body can be moved in the radial direction through the center of the storage tank. Therefore, in a case in which the storage time of the liquid is relatively long and significant aggregation has occurred at the center part, for example, aggregation can be effectively broken up by moving the spherical body through the center in the radial direction.

With the method as described above, the movement paths preferably include a first movement path of movement in the circumferential direction, and a second movement path including both movement in the circumferential direction and movement in the radial direction of the storage tank.

Through this configuration, the first movement path and the second movement path can be arbitrarily selected according to the aggregation state.

With the method as described above, the predetermined selection condition is preferably set according to a storage time of the fluid in the storage tank.

Through this configuration, the movement path of the spherical body can be selected from a plurality of movement paths with the storage time of the fluid as a threshold value criterion for measuring the aggregation state.

With the method as described above, the predetermined selection condition is preferably set according to a time from a start of attraction of the spherical body.

Through this configuration, the abovementioned second path, for example, may be selected at the start of attraction, when the aggregation state is relatively severe, and the abovementioned first path, for example, may be selected after the start of attraction, when the aggregation state has decreased.

The method as described above preferably further includes adjusting a movement speed of the spherical body according to the selected movement path.

Through this configuration, since the movement of the spherical body may cause bubbles to form when the spherical body moves in the path through the center of the storage tank, for example, the movement of the spherical body can be prevented from forming bubbles by reducing the movement speed of the spherical body when such a path is taken.

A fluid storage device for storing a fluid according to another aspect includes: a storage tank; a spherical body formed of a magnetic material and provided inside the storage tank; three or more attraction devices configured and arranged to selectively attract the spherical body; and a switching device configured and arranged to switch between attraction and non-attraction by each of the attraction devices according to a movement path selected from a plurality of movement paths based on a predetermined selection condition, and to move the spherical body inside the storage tank in the selected movement path.

Consequently, in the fluid storage device according to this aspect, by switching separately between attraction and non-attraction by the attraction devices to move the spherical body in a predetermined movement path, aggregation can be effectively broken up by bringing the spherical body into contact with an aggregated part (precipitate) of the liquid. By also selecting the movement path of the spherical body according to the aggregation state in the liquid, the spherical body can be effectively moved through areas of significant aggregation, and other areas.

A method according to another aspect is a method for stirring a fluid in a fluid storage device having a storage tank for storing a fluid with a spherical body formed of a magnetic material provided inside the storage tank. The method comprising: selecting a movement path for the spherical body inside the storage tank from a plurality of movement paths based on a predetermined selection condition; and switching between attraction and non-attraction by each of three or more attraction devices configured and arranged to selectively attract the spherical body according to the selected movement path.

Consequently, by the fluid stirring method for a fluid ejection device according to this aspect, by switching separately between attraction and non-attraction by the attraction devices to move the spherical body in a predetermined movement path, aggregation can be effectively broken up by bringing the spherical body into contact with an aggregated part (precipitate) of the liquid. By also selecting the movement path of the spherical body according to the aggregation state in the liquid, the spherical body can be effectively moved through areas of significant aggregation, and other areas.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
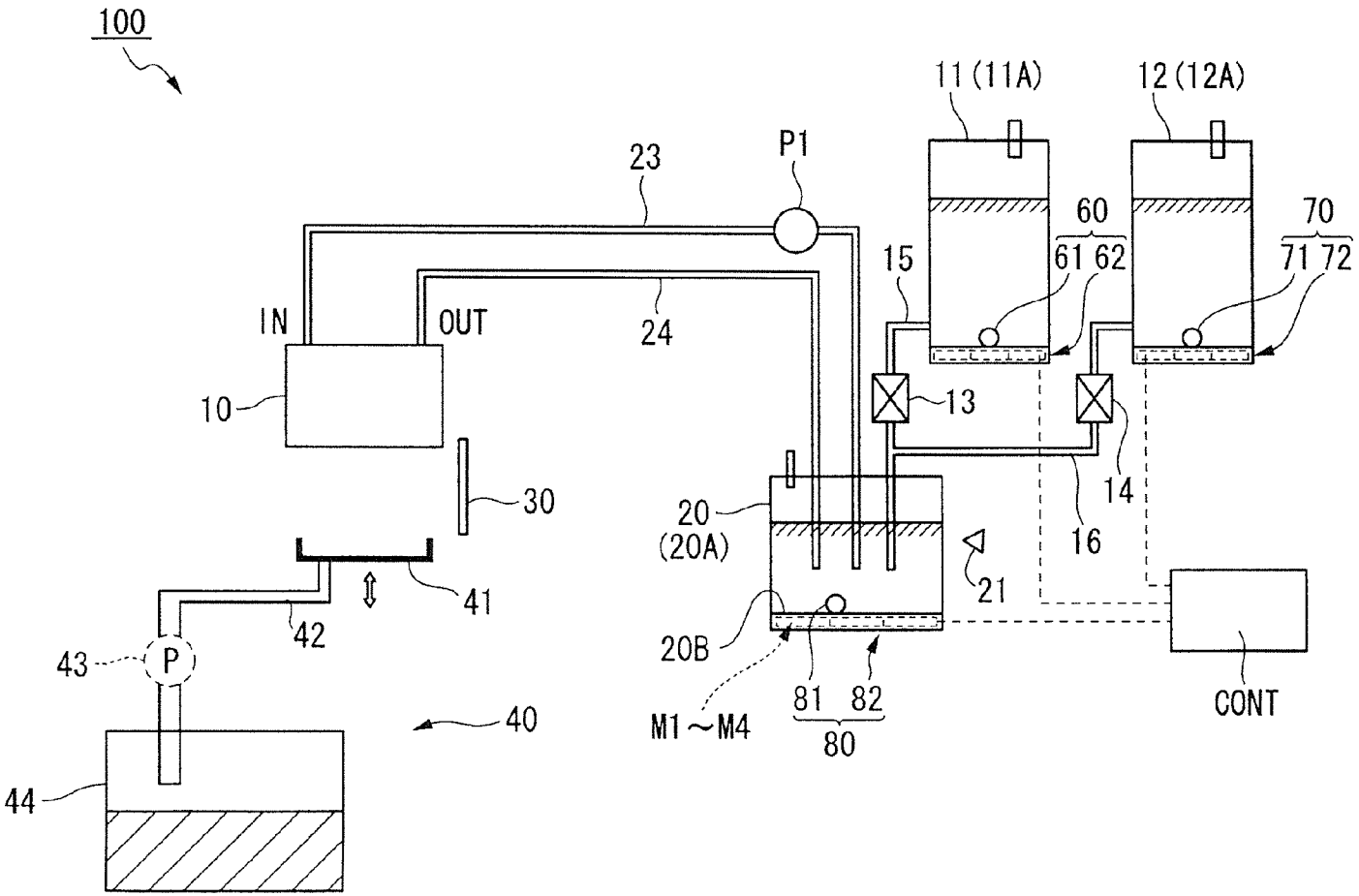
FIG. 1 is a schematic view showing the configuration of the inkjet-type printer of the present embodiment.

Embodiments of the fluid ejection device and fluid stirring method thereof, and the fluid storage device and fluid stirring method thereof according to the present invention will be described with reference to FIGS. 1 through 3.

The embodiments described below are merely examples of the present invention and as such do not limit the present invention, and may be freely modified within the intended technical scope of the present invention. In order to facilitate understanding of components in the drawings referenced below, the scale, number of elements, and other aspects of each structure differ from the actual structure.

In the present embodiment, an inkjet-type printer is described as an example of the fluid ejection device of the present invention.

FIG. 1 is a schematic view showing the configuration of the inkjet-type printer (inkjet printer (fluid ejection device) 100 hereinafter) of the present embodiment.

The inkjet printer 100 is provided with an ejection head (fluid ejection head) 10, ink cartridges (fluid storage devices) 11, 12, a sub-tank (fluid storage device) 20, a wiper 30, and a capping device 40 which has a cap member 41.

The ink cartridges 11, 12 are provided with bottomed cylindrical storage tanks 11A, 12A, respectively, and white ink, for example, is stored in each of the storage tanks 11A, 12A. The ink stored in the ink cartridges 11, 12 is fed to the sub-tank 20 via feed tubes 15, 16 by the opening of valve units 13, 14.

The ink used in the present embodiment has a recording material (dye or pigment) and a solvent for dissolving or dispersing the recording material as basic components thereof, and various additives may be added thereto as needed.

White ink (W) is obtained by adding pigment particles (microparticles) composed of titanium dioxide to water as the solvent. The specific gravity of normal pigment is approximately 1.0 to 0.3, whereas the specific gravity of titanium dioxide is 3.7 to 4.2. The added amount of titanium dioxide is preferably in the range of about 1 to 50% by mass, more preferably 3 to 30% by mass, with respect to the entire quantity of ink. When the added quantity is less than 1% by mass, the ink has reduced hiding properties when printed, and when the added quantity is greater than 50% by mass, problems may arise in the dispersion properties of the titanium dioxide, and it is difficult to prevent the nozzles of the ejection head 10 from clogging.

An organic solvent or a solvent obtained by adding an aqueous organic solvent or the like to water may be used as the solvent. The solvent used may also include a UV-curable resin. Specific examples of the ink composition may include those described in paragraphs 0039 and 0040 of Japanese Laid-open Patent Publication No. 2002-348513 by the present applicants.

The sub-tank 20, having a bottomed cylindrical storage tank 20A, stores the ink fed from the ink cartridges 11, 12 to the storage tank 20A, and is provided with a level sensor 21 for detecting the liquid level (i.e., stored amount of ink) of the ink. The ink stored in the sub-tank 20 is fed to the ejection head 10 via a feed tube 23 in response to the driving of a pump P1, and is discharged to the sub-tank 20 via a discharge tube 24. In other words, a configuration is adopted whereby the ink stored in the sub-tank 20 is circulated between the sub-tank 20 and the ejection head 10.

The capping device 40 has a cap member 41, a discharge tube 42 connected to a bottom part of the cap member 41, and a suction mechanism 43 disposed partway in the discharge tube 42. The suction mechanism 43 is driven in a state in which the cap member 41 is in contact with a nozzle surface of the ejection head 10, and the air in the ejection head 10 can thereby be suctioned to fill the ejection head with ink. The ink suctioned with the air is discharged to a waste liquid tank 44. Ink is also ejected to the cap member 41 during preliminary ejection (flushing) of ink from the ejection head 10. After maintenance by the capping device 40, the nozzle surface is wiped by the wiper 30.

Stirring devices 60, 70, 80 for stirring the ink stored in the ink cartridges 11, 12 and the sub-tank 20, respectively, are also provided in the inkjet printer 100 of the present embodiment. The stirring device 60 is composed of a spherical body 61 obtained by applying a fluororesin coating, for example, to a spherical piece of iron or other magnetic material provided inside the storage tank 11A, and an attraction device 62 for attracting the spherical body 61 by magnetic force. The stirring device 70 is also composed of a spherical body 71 obtained by applying a fluororesin coating, for example, to a spherical piece of iron or other magnetic material provided inside the storage tank 12A, and an attraction device 72 for attracting the spherical body 71 by magnetic force. The stirring device 80 is composed of a spherical body 81 obtained by applying a fluororesin coating, for example, to a spherical piece of iron or other magnetic material provided inside the storage tank 20A, and an attraction device 82 for attracting the spherical body 81 by magnetic force.

The spherical bodies 61, 71, 81 have a specific gravity greater than the ink, and are designed to sink to the bottom even when placed in ink.

Since the stirring devices 60, 70, 80 each have the same configuration, the stirring device 80 of the sub-tank 20 will be described below as a representative configuration.

Figure 2:
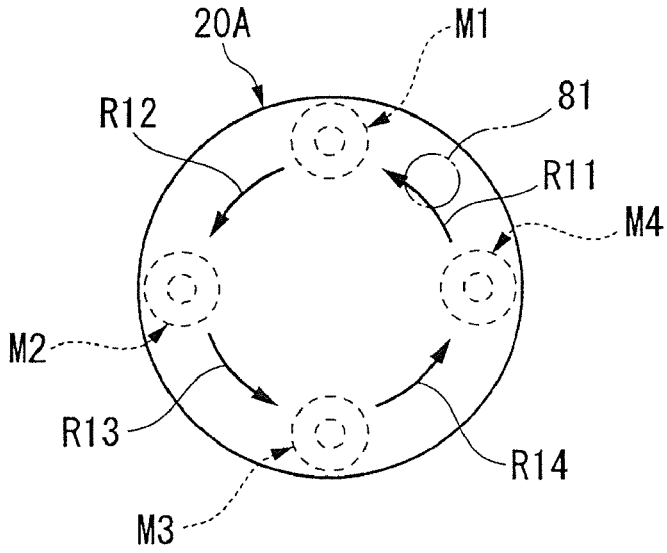
FIG. 2 is a view showing the first movement path of the spherical body.
Figure 3:
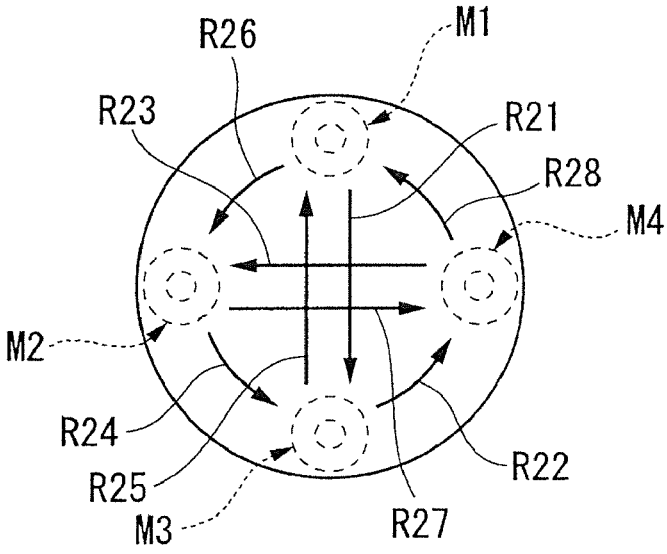
FIG. 3 is a view showing the second movement path of the spherical body.

As shown in FIG. 2, the attraction device 82 of the stirring device 80 has a plurality (four in this example) of electromagnets M1 through M4 disposed further downward than a bottom wall 20B of the storage tank 20A. The electromagnets M1 through M4 are disposed at fixed intervals (90-degree intervals) in the circumferential direction of the storage tank 20A. The electromagnet M1 and the electromagnet M3 are disposed so as to form a pair on both sides of the center in the radial direction, and in the same manner, the electromagnet M2 and the electromagnet M4 are disposed so as to form a pair on both sides of the center in the radial direction. Supplying of power (ON/OFF) to the electromagnets M1 through M4 and the amount of power fed thereto are controlled by a control device CONT (see FIG. 1).

The stirring operation by the stirring device 80 configured as described above will next be described.

In the present embodiment, a plurality of movement paths (two in this example) is set for the spherical body 81 when the spherical body 81 is attracted by the operation of the electromagnets M1 through M4, and the control device CONT selects a movement path based on a predetermined selection condition and controls the power to the electromagnets M1 through M4, thereby acting as a switching device for switching the movement path.

Specifically, as shown in FIG. 2, when only the electromagnet M1, for example, is powered of the electromagnets M1 through M4 disposed at intervals in the circumferential direction, the spherical body 81 attracted by magnetic force moves in a path R11 toward the electromagnet M1. When the spherical body 81 reaches the position of the electromagnet M1 (planar position, the position in the height direction actually being different), power to the electromagnet M1 is cut and applied to the electromagnet M2, whereupon the moving spherical body 81 is moved in a path R12 counterclockwise in FIG. 2 in the circumferential direction by inertia and attraction by the electromagnet M2.

When the spherical body 81 reaches the position of the electromagnet M2 power to the electromagnet M2 is cut and applied to the electromagnet M3. By sequentially supplying and cutting power to the electromagnets M1 through M4 in the circumferential direction in this manner, the spherical body 81 is made to move orbitally in a first movement path (movement path shown in FIG. 2) counterclockwise in the circumferential direction of the storage tank 20A so as to move in order through path R11, path R12, path R13, path R14, path R11, and so on.

On the other hand, by the control device CONT supplying and cutting power to the electromagnets in the order M1, M3, M4, M2, M3, M1, M2, M4, M1, M3, and so on, the spherical body 81 is made to move in a second movement path of alternation between movement in the circumferential direction of the storage tank 20A and movement in the radial direction through the center of the storage tank 20A, in order through path R21, path R22, path R23, path R24, path R25, path R26, path R27, path R28, path R21, and so on.

The control device CONT retains a power supply pattern for the electromagnets M1 through M4 in advance for moving the spherical body 81 in the first and second movement paths described above, and selects a movement path according to a selection condition in effect at the time of stirring.

For example, when the storage time of the ink in the stirring device 80 (storage tank 20A) is equal to or less than a predetermined threshold value when stirring is applied, the control device CONT selects the first movement path under the assumption that aggregation is not significantly advanced, and powers the electromagnets M1 through M4 according to the power supply pattern that corresponds to the first movement path. Since the spherical body 81 moves orbitally in the circumferential direction at this time, the ink can be stirred without bubbles being formed by the movement thereof. Ink in regions removed from the movement path of the spherical body 81 can also be stirred by the liquid current (vortex) that accompanies orbital movement of the spherical body 81.

On the other hand, in the case that the storage time of the ink in the stirring device 80 (storage tank 20A) exceeds the predetermined threshold value, the control device CONT selects the second movement path under the assumption that aggregation is advanced and a precipitate is present, and powers the electromagnets M1 through M4 according to the power supply pattern that corresponds to the second movement path. The precipitate formed by aggregation is difficult to break up solely by the vortex created by movement of the spherical body 81, and the spherical body 81 does not come in direct contact with an aggregation or precipitate at the center during the orbital movement described above. The spherical body 81 is therefore moved in the second movement path so that the spherical body 81 moves in the radial direction through the center in path R21, path R23, path R25, and path R27 to contact the aggregated precipitate.

Bubbles may be formed by cavitation or the like as the spherical body 81 moves in the radial direction. During orbital movement of the spherical body 81, most of the bubbles that form rise and are eliminated after being drawn toward the outer periphery by the vortex of the ink. However, since a vortex does not readily form when the spherical body 81 is moved in the second movement path, the bubbles are difficult to eliminate. The control device CONT therefore reduces the amount of power to the electromagnets M1 through M4 to reduce the movement speed and make bubbles less prone to form in the path R21, path R23, path R25, and path R27 in which the spherical body 81 is moved in the radial direction through the center.

In the case that the spherical body 81 is moved in the second movement path, since it can be inferred that aggregation or a precipitate at the center part has been broken up when a predetermined time has elapsed after the start of attraction of the spherical body 81, the control device CONT switches the power supply pattern for the electromagnets M1 through M4 when a predetermined time elapses from the start of attraction of the spherical body 81, and switches from the second movement pattern to the first movement pattern to move the spherical body 81.

When stirring of the ink in the ink cartridges 11, 12 and the sub-tank 20 in this manner is completed, the ink of the ink cartridges 11, 12 and the sub-tank 20 is sequentially fed to the ejection head 10, and fluid ejection is performed.

As described above, the spherical body 81 is moved in a movement path selected from a first and second movement path based on a predetermined selection condition in the present embodiment. The ink can therefore be effectively stirred and aggregation broken up according to the aggregation state of the ink, and a rapid transition can be made to fluid ejection. In particular, since the movement path is selected according to the storage time of the ink and the elapsed time from the start of attraction of the spherical body in the present embodiment, the ink can be stirred so as to break up aggregation in the shortest amount of time.

Since the movement speed of the spherical body is reduced in the path in the radial direction through the center of the storage tank in the present embodiment, the movement of the spherical body can be prevented from forming bubbles, and the quality of the ink can be stabilized and maintained.

A preferred embodiment of the present invention is described above with reference to the accompanying drawings, but it shall be apparent that the present invention is not limited by this example. The shapes, combinations, and other aspects of the constituent members described in the example above are merely examples, and may be modified in various ways based on design requirements within the intended scope of the present invention.

For example, in the embodiment described above, a configuration is described in which four electromagnets are provided, but this configuration is not limiting, and configurations are possible in which three electromagnets are provided, or in which five or more electromagnets are provided. In a case in which three electromagnets are used, in order to move the spherical body in the radial direction through the center of the storage tank, after the spherical body is attracted by one electromagnet, power is supplied to the remaining two electromagnets simultaneously to attract the spherical body while balancing the magnetic force from both electromagnets until the spherical body has passed through the center, at which time the magnetic force of one of the two electromagnets is made greater than that of the other electromagnet.

A configuration is adopted in the above embodiment whereby the spherical body is attracted using electromagnets M1 through M4, but this configuration is not limiting, and permanent magnets, for example, may also be used to attract the spherical body. In this case, in order to switch between attraction and non-attraction of the spherical body, a drive device is provided for driving a permanent magnet away from or towards the storage tank, so as to attract the spherical body by bringing the permanent magnet close to the storage tank, and removing the attraction to the spherical body by separating the permanent magnet from the storage tank.

Two movement paths are described in the embodiment above, but it shall be apparent that three or more movement paths may be set, and that the optimum movement path may be set as appropriate according to a selection condition.

In the embodiment above, the fluid storage device and fluid stirring method thereof according to the present invention are described as being applied to ink cartridges 11, 12 and a sub-tank 20 in a fluid ejection device (inkjet printer 100), but this configuration is not limiting, and the present invention can be applied to any device for storing a liquid in which aggregation or precipitation occurs. The present invention is also broadly applicable to a fluid ejection device such as in the case described above in which a liquid dispersion including metal microparticles is used.

The cross-sectional shape of the storage tanks 11A, 12A, 20A in plan view is also not limited to being circular, and may be rectangular, for example.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A fluid ejection device comprising:

a fluid storage device configured and arranged to retain a fluid, the fluid storage device including a storage tank, and a spherical body formed of a magnetic material and provided inside the storage tank;

three or more attraction devices configured and arranged to selectively attract the spherical body;

a switching device configured and arranged to switch between attraction and non-attraction by each of the attraction devices according to a movement path selected from a plurality of movement paths based on a predetermined selection condition, and to move the spherical body inside the storage tank in the selected movement path; and a fluid ejection head configured and arranged to eject the fluid fed from the fluid storage device.

2. The fluid ejection device according to claim 1, wherein the attraction devices are disposed at a distance from the storage tank in a circumferential direction of the storage tank.

3. The fluid ejection device according to claim 2, wherein the attraction devices are provided as a pair of the attraction devices disposed on both sides of a center of the storage tank in a radial direction of the storage tank.

4. The fluid ejection device according to claim 3, wherein the movement paths include a first movement path of movement in the circumferential direction, and a second movement path including both movement in the circumferential direction and movement in the radial direction of the storage tank.

5. The fluid ejection device according to claim 1, wherein the predetermined selection condition is set according to a storage time of the fluid in the storage tank.

6. The fluid ejection device according to claim 1, wherein the predetermined selection condition is set according to a time from a start of attraction of the spherical body.

7. The fluid ejection device according to claim 1, wherein the switching device is configured and arranged to adjust a movement speed of the spherical body according to the selected movement path.

8. A method for stirring a fluid in a fluid storage device in a fluid ejection device including the fluid storage device having a storage tank for storing a fluid with a spherical body formed of a magnetic material provided inside the storage tank, and a fluid ejection head for ejecting the fluid fed from the fluid storage device, the method comprising:

selecting a movement path for the spherical body inside the storage tank from a plurality of movement paths based on a predetermined selection condition; and switching between attraction and non-attraction by each of three or more attraction devices configured and arranged to selectively attract the spherical body according to the selected movement path.

9. The method for according to claim 8, wherein the attraction devices are disposed at a distance from the storage tank in a circumferential direction of the storage tank.

10. The method according to claim 9, wherein the attraction devices are provided as a pair of the attraction devices disposed on both sides of a center of the storage tank in a radial direction of the storage tank.

11. The method according to claim 10, wherein the movement paths include a first movement path of movement in the circumferential direction, and a second movement path including both movement in the circumferential direction and movement in the radial direction of the storage tank.

12. The method according to claim 8, wherein the predetermined selection condition is set according to a storage time of the fluid in the storage tank.

13. The method according to claim 8, wherein the predetermined selection condition is set according to a time from a start of attraction of the spherical body.

14. The method according to claim 8, further comprising adjusting a movement speed of the spherical body according to the selected movement path.

15. A fluid storage device for storing a fluid comprising:

a storage tank;

a spherical body formed of a magnetic material and provided inside the storage tank;

three or more attraction devices configured and arranged to selectively attract the spherical body; and a switching device configured and arranged to switch between attraction and non-attraction by each of the attraction devices according to a movement path selected from a plurality of movement paths based on a predetermined selection condition, and to move the spherical body inside the storage tank in the selected movement path.

* * * * *